US005249687A

United States Patent [19]

Rosenbaum et al.

[11] Patent Number: 5,249,687

[45] Date of Patent: Oct. 5, 1993

[54] BARCODE TRANSLATION FOR DEFERRED OPTICAL CHARACTER RECOGNITION MAIL PROCESSING

[75] Inventors: Walter S. Rosenbaum, Bethesda, Md.; Barr T. Carris, McLean, Va.; Anker Ankerstjerne, Copenhagen, Denmark

[73] Assignee: International Business Machines Corporation, Armonk, N.Y.

[21] Appl. No.: 690,175

[22] Filed: Apr. 19, 1991

[51] Int. Cl.[5] ..... B07C 5/02

[52] U.S. Cl. ..... 209/3.3; 209/584; 209/900; 235/432; 364/478

[58] Field of Search ..... 209/3.3, 583, 584, 900; 382/1; 235/375, 432; 364/478

[56] References Cited

U.S. PATENT DOCUMENTS

| | | | |
|---|---|---|---|
| 3,184,061 | 5/1965 | Levy | 209/552 |
| 4,632,252 | 12/1986 | Haruki et al. | 209/546 |
| 4,796,196 | 1/1989 | Durst, Jr. et al. | 209/3.3 X |
| 4,832,204 | 5/1989 | Handy et al. | 209/3.3 |
| 4,845,761 | 4/1989 | Cate et al. | 382/1 |
| 5,009,321 | 4/1991 | Keough | 209/584 X |
| 5,042,667 | 8/1991 | Keough | 209/584 X |

FOREIGN PATENT DOCUMENTS

| | | | |
|---|---|---|---|
| 0095737 | 12/1983 | Japan | 209/900 X |

*Primary Examiner*—Andres Kashnikow
*Assistant Examiner*—Joseph A. Kaufman
*Attorney, Agent, or Firm*—John E. Hoel

[57] ABSTRACT

A system and method are disclosed for enabling the technique of deferred processing of OCR scanned mail to be compatible with existing techniques for mechanical sortation of mail that use standard sort barcode formats which are common to a given destination postal system. This enables deferred OCR processed mail to be sorted on an unsegregated basis along with other types of mail which have not been processed by the deferred OCR technique. This allows the OCR encoded mail to be processed along with other types of encoded mail during standard sort barcode that has been imprinted using prior technology such as OCR or manual code desks.

21 Claims, 13 Drawing Sheets

LOCAL SORTATION INFORMATION TABLE 241 FOR AKRON POST OFFICE P1

| ZIP CODE 42 | BLOCK 234 | BLOCK CODE 236 | | CARRIER 230 | CODE 232 |
|---|---|---|---|---|---|
| 12345 | 001 - 099 MAIN ST. | 001 | B11 | ABLE | 003 |
| | 100 - 199 MAIN ST. | 002 | B12 | C1 | |
| | 200 - 299 MAIN ST. | 003 | B13 | | |
| | 001 - 099 ELM ST. | 001 | B21 | BAKER | 004 |
| | 100 - 199 ELM ST. | 002 | B22 | C2 | |
| | 200 - 299 ELM ST. | 003 | B23 | | |
| | 001 - 099 FIRST ST. | 001 | B31 | CHARLIE | 006 |
| | 100 - 199 FIRST ST. | 002 | B32 | C3 | |
| | 200 - 299 FIRST ST. | 003 | B33 | | |
| | 001 - 099 PARK PL. | 001 | | DAGWOOD | 007 |
| | 100 - 199 PARK PL. | 002 | | | |
| | 200 - 299 PARK PL. | 003 | | | |

*FIG. 11*

LOCAL SORTATION INFORMATION TABLE 241 FOR AKRON POST OFFICE P2

| ZIP CODE 42 | BLOCK 234 | BLOCK CODE 236 | CARRIER 230 | CODE 232 |
|---|---|---|---|---|
| 12366 | 001 - 099 EADS ST. | 001 | ELWOOD | 013 |
| | 100 - 199 EADS ST. | 002 | | |
| | 200 - 299 EADS ST. | 003 | | |
| | 001 - 099 OAK ST. | 001 | FLOYD | 014 |
| | 100 - 199 OAK ST. | 002 | | |
| | 200 - 299 OAK ST. | 003 | | |
| | 001 - 099 THIRD ST. | 001 | GEORGE | 016 |
| | 100 - 199 THIRD ST. | 002 | | |
| | 200 - 299 THIRD ST. | 003 | | |
| | 001 - 099 LAKE PL. | 001 | HEROLD | 017 |
| | 100 - 199 LAKE PL. | 002 | | |
| | 200 - 299 LAKE PL. | 003 | | |

*FIG. 11A*

LOCAL STANDARD FORMAT 243 FOR SORTATION INFORMATION 200' FOR SMITH CO., 123 ELM ST., AKRON, OH, 12345

| ZIP CODE 42 | CARRIER CODE 232 | BLOCK CODE 236 | |
|---|---|---|---|
| | | | LOCAL FORMAT 243 |
| 12345 | 004 | 002 | LOCAL INFO. 200' |

FIG. 12

LOCAL CODE PAGE 245 FOR AKRON, OHIO 46 0 = |
1 = || 48

FIG. 13

LOCAL STANDARD SORT BAR CODE 200 FOR SMITH CO., 123 ELM ST., AKRON, OH, 12345

| ZIP CODE (FIVE DIGITS) 42 | CARRIER CODE 232 | BLOCK CODE 236 | |
|---|---|---|---|
| | | | LOCAL FORMAT 243 |
| 0001 0010 0011 0100 0101 | 100 | 010 | LOCAL INFO. 200' |
| ||||| |||| ||||| |||| ||||| | ||| | ||| | LOCAL BAR CODE 200 |

FIG. 14

LOCAL SORT CODE TRANSLATION TABLES 210

| |
|---|
| TABLE 241 OF LOCAL SORTATION INFORMATION FOR LOCAL POST OFFICE P1 (FIG. 11) |
| TABLE 241 OF LOCAL SORTATION INFORMATION FOR LOCAL POST OFFICE P2 (FIG. 11A) |
| LOCAL FORMAT 243 FOR SORTING INFO. 200' FOR DESTINATION REGION 28 (FIG. 12) |
| LOCAL CODE PAGE 245 FOR BAR CODE 48 FOR DESTINATION REGION 28 (FIG. 13) |

LOCAL CODE PAGE 245 FOR DAYTON, OHIO 46 0 = I 48'
1 = II

FIG. 18

LOCAL STANDARD SORT BAR CODE 200 FOR DAYTON, OHIO

| ZIP CODE (LAST THREE DIGITS) 42 | CARRIER CODE 232 | BLOCK CODE 236 | |
|---|---|---|---|
| | | | LOCAL FORMAT 243 |
| 0011 0100 0101 | 100 | 010 | LOCAL INFO. 200' |
| IIIII IIII I IIIII | III | III | LOCAL BAR CODE 200 |

FIG. 19

LOCAL CODE PAGE 245 FOR COPENHAGEN, DENMARK 46 0 = ⅂ 48"
1 = I

FIG. 20

LOCAL STANDARD SORT BAR CODE 200 FOR COPENHAGEN, DENMARK

| ZIP CODE (LAST TWO DIGITS) 42 | CARRIER CODE 232 | BLOCK CODE 236 | |
|---|---|---|---|
| | | | LOCAL FORMAT 243 |
| 0100 0101 | 100 | 010 | LOCAL INFO. 200' |
| ⅂I⅂⅂ ⅂I⅂I | I⅂⅂ | ⅂I⅂ | LOCAL BAR CODE 200 |

FIG. 21

BARCODE TRANSLATION FOR DEFERRED OPTICAL CHARACTER RECOGNITION MAIL PROCESSING

BACKGROUND OF THE INVENTION

1. Technical Field

The invention disclosed broadly relates to automated mail processing and more particularly relates to improvements in the use of optical character recognition for mail processing.

2. Background Information

The technique of deferred processing of OCR scanned mail is disclosed in the copending U.S. patent application Ser. No. 07/426,617, filed Oct. 24, 1989 now U.S. Pat. No. 5,031,223 by Walter S. Rosenbaum, et al., assigned to the IBM Corporation, incorporated herein by reference. The process of deferred processing of OCR scanned mail is based on the concept of "just-in-time manufacturing" as applied to the sorting information required to complete delivery after a physical mail piece is received at a destination postal location. In the copending Rosenbaum, et al. patent application, a physical mail piece is input at the sending postal location and has its front face scanned with an image capturing device to provide a digitized image of at least the destination address block for a mail piece. If the address block is machine readable, a character recognition system analyzes at least the state and city information or the zip code information in the destination address block of the image, providing an alphanumeric string of recognized information representing the city, state and/or zip code for the intended destination of the mail piece. If the address block is not machine readable, for example because it is a handwritten cursive script, then an operator will view the captured image of the address block and will rekey the city, state and zip code, providing the alphanumeric string. With this amount of information, the physical mail piece can be forwarded for physical delivery on a truck, airplane or other conveyance and the process of character recognition for the balance of the destination address block can be deferred. As a part of the process of capturing the image of the destination address block, a serial number is assigned to the physical mail piece and is associated with the captured image in a mail piece electronic folder. The value of the serial number is encoded in barcode form on the mail piece at the sending location. In this manner, the physical mail piece and the electronic folder can be related at the destination postal location. In the copending Rosenbaum, et al. patent application, while the physical mail piece is in transit from the sending location to the destination location, some or all of the balance of the address information in the image of the address block will be character recognized, if the address block is machine readable. If the address block is not machine readable, for example because it is a handwritten cursive script, then an operator will view the captured image of the address block and will rekey some or all of the balance of the address information in the image of the address block. All of the character recognized or rekeyed alphanumeric strings are incorporated into the mail piece electronic folder and transmitted to the destination postal location over a data communications network. When the physical mail piece is received at the destination postal location, its barcode serial number is read from the front of the mail piece and used as a query term for accessing from the data communications network, the portion of the mail piece electronic folder containing the balance of the character recognized information sufficient to perform sorting of the physical mail piece at the destination postal location. In the copending Rosenbaum, et al. patent application, the barcoded serial number is read from the front of the mail piece, the system accesses the character recognized information from the system and that character recognized information is used to drive a mechanical sorting device to sort the physical mail piece into the appropriate sorting scheme for further mechanical delivery stages.

The postal systems in the United States and in other countries have zip code and postal address coding conventions that yield barcoded fields that allow automatic sortation to some desired level during the incoming sort process. For example, the United States has a zip code of nine numerical digits which is used to sort physical mail pieces at the destination postal location down to the postal carrier and in some instances, down to buildings within a carrier's route. However other countries such as Canada, have other postal address code conventions. Canada, for example has a six digit code which consists of alternating alphabetic and numerical characters. The Canadian postal address code is used to sort a physical mail piece down to the carrier.

What is needed is a system employing the deferred OCR processing technique, which provides for the diversity of conventional postal address code formats and information contents used in diverse countries. In addition, what is needed is the ability to use the technique of deferred processing of OCR scanned mail in an existing postal system where a barcode reader reads a conventional postal address code and drives the mechanical sorter to sort the physical mail piece. What is needed is a mechanism for translating the serial number imprinted on the mail piece into the conventional postal address code which is unique to a particular country or region, so as to enable a translated, conventional barcode imprinted on the front of the mail piece to be read by a conventional barcode reader and sorted by a conventional sorting machine, along with all the other mail that has been introduced into the system by other preexisting postal devices such as OCR sort machines or manual coding desks.

OBJECTS OF THE INVENTION

It is therefore an object of the invention to provide an improved technique for sorting mail pieces in a deferred mail processing system.

It is still a further object of the invention to provide an improved technique for deferred processing of mail which enables the use of local conventions of barcode reading and sorting of the mail pieces during the incoming sort at the destination location.

SUMMARY OF THE INVENTION

These and other objects, features and advantages are provided by the invention disclosed herein. The invention is used in a system for deferred processing of a mail piece having a destination address block whose image is character recognized to produce destination address data. This data associated with an identification number encoded as an indicium onto the mail piece. The destination address data is transmitted over a network to a mail piece distribution station which distributes the mail piece to a sorting station using a local sort code. The invention is a method and apparatus for encoding the mail piece for automatic sorting down to any desired level including carrier walk delivery sequencing at the destination location.

The invention includes a computer memory coupled to the network, for storing the destination address data and for storing local sort code translation tables. A reader is coupled to the computer memory, for identifying the mail piece at the distribution station by reading the indicium thereon. A data processor is coupled to the memory and the reading means, for accessing the destination address data using the identification number represented by the indicium.

In accordance with the invention, the data processor converts the destination address data into a local sort code using the translation tables. A printer is coupled to the data processor, for printing the local sort code onto the mail piece.

A sorter can then read the printed local sort code on the mail piece and sort the mail piece down to the carrier and walk sequence at the destination location.

The indicium can be a barcode with a first format and the printed local sort code can be a barcode with a second format, and this is accommodated by the translation tables including a local format table to convert the destination address data to the second format. Also, the indicium can be a barcode with a first bar character shape and the printed local sort code is a barcode with a second bar character shape, and this can be accommodated by the translation tables including a local code page to convert the destination address data to the second bar character shape.

The translation tables include local sortation information having a carrier code and a block code, enabling the printed local sort code to control the sorter to sort the mail piece down to carrier and walk sequence.

The translation tables can include a second local sortation information for a second destination location served by the distribution station, where the local post offices have different types of sort machines, each with its own barcode format.

In this manner, automatic sorting can be performed down to the carrier and walk sequence at the destination location.

DESCRIPTION OF THE FIGURES

These and other objects, features and advantages will be more fully appreciated with reference to the accompanying figures.

FIG. 11 illustrates the local sortation information table 241 for the local Akron Post Office P1.

FIG. 11A illustrates the local sortation information table 241 for the local Akron Post Office P2.

FIG. 12 illustrates the local standard format 243.

FIG. 13 illustrates the local code page 245.

FIG. 14 illustrates the resulting local standard barcode 200 for mail pieces A, E and I.

FIG. 18 illustrates a second example of a local code page 245.

FIG. 19 illustrates a second example of a local standard sort barcode.

FIG. 20 illustrates a third example of a local code page 245.

FIG. 21 illustrates a third example of a local standard sort barcode.

DISCUSSION OF THE PREFERRED EMBODIMENT

Figure 1:
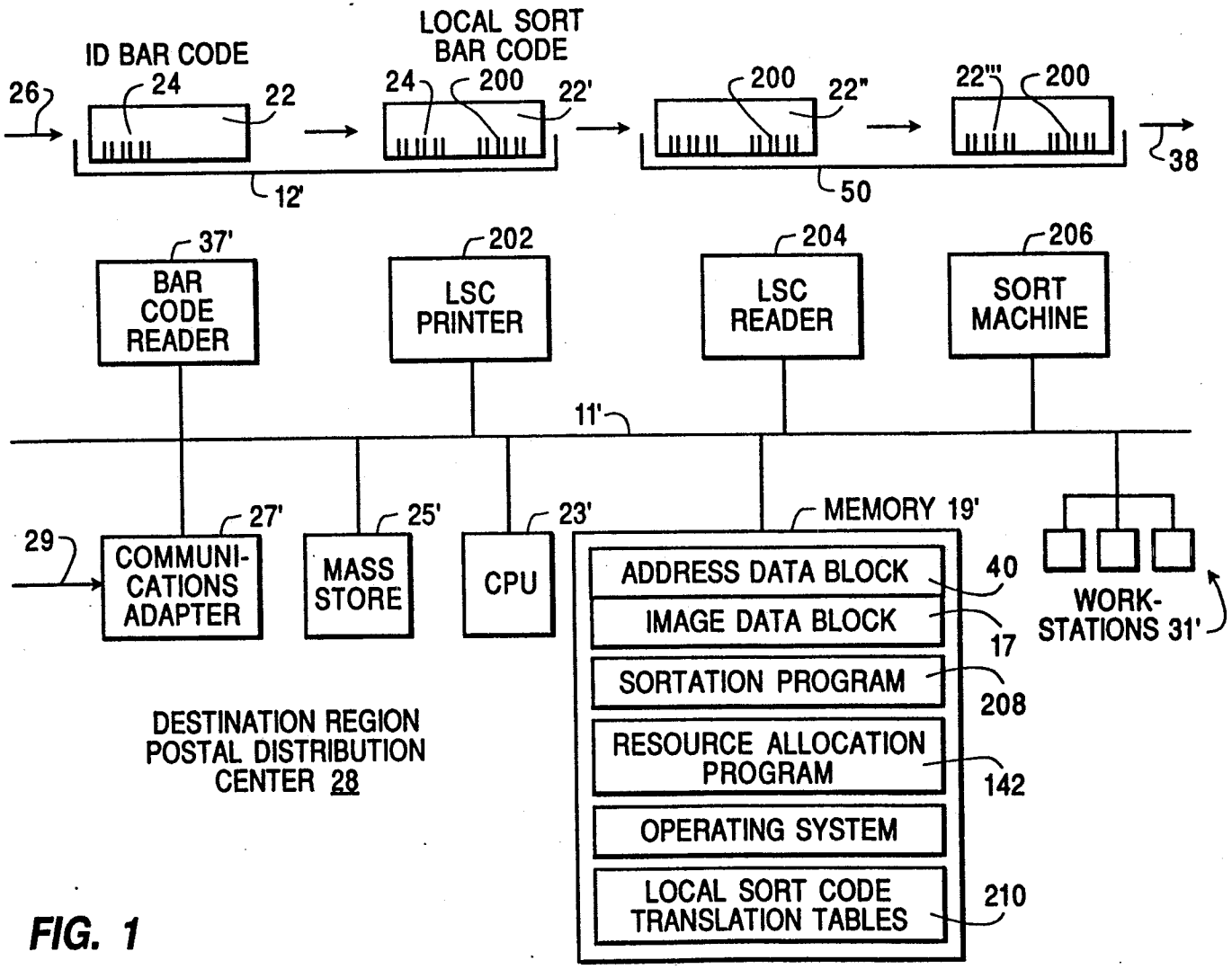
FIG. 1 is an architectural diagram of the data processing system at the destination region postal distribution center 28, in accordance with the invention.

The copending patent application Ser. No. 07/426,617, filed Oct. 24, 1989 by Walter S. Rosenbaum, et al. entitled "System and Method for Deferred Processing of OCR Scanned Mail," assigned to the IBM Corporation, is incorporated herein by reference for an explanation of the foundation technique for deferred processing of mail. Reference numbers appearing in the Rosenbaum, et al. patent application are repeated in this specification to identify similar elements. This technique of deferred processing of OCR scanned mail is improved upon by the invention disclosed herein. Reference can be made to FIG. 1 herein which shows an architectural diagram of the data processing system used at the destination region postal distribution center 28 to use the local standard sort barcode at the destination location to complete the processing of the incoming mail piece through the various stages of mechanical sorting.

Figure 2:
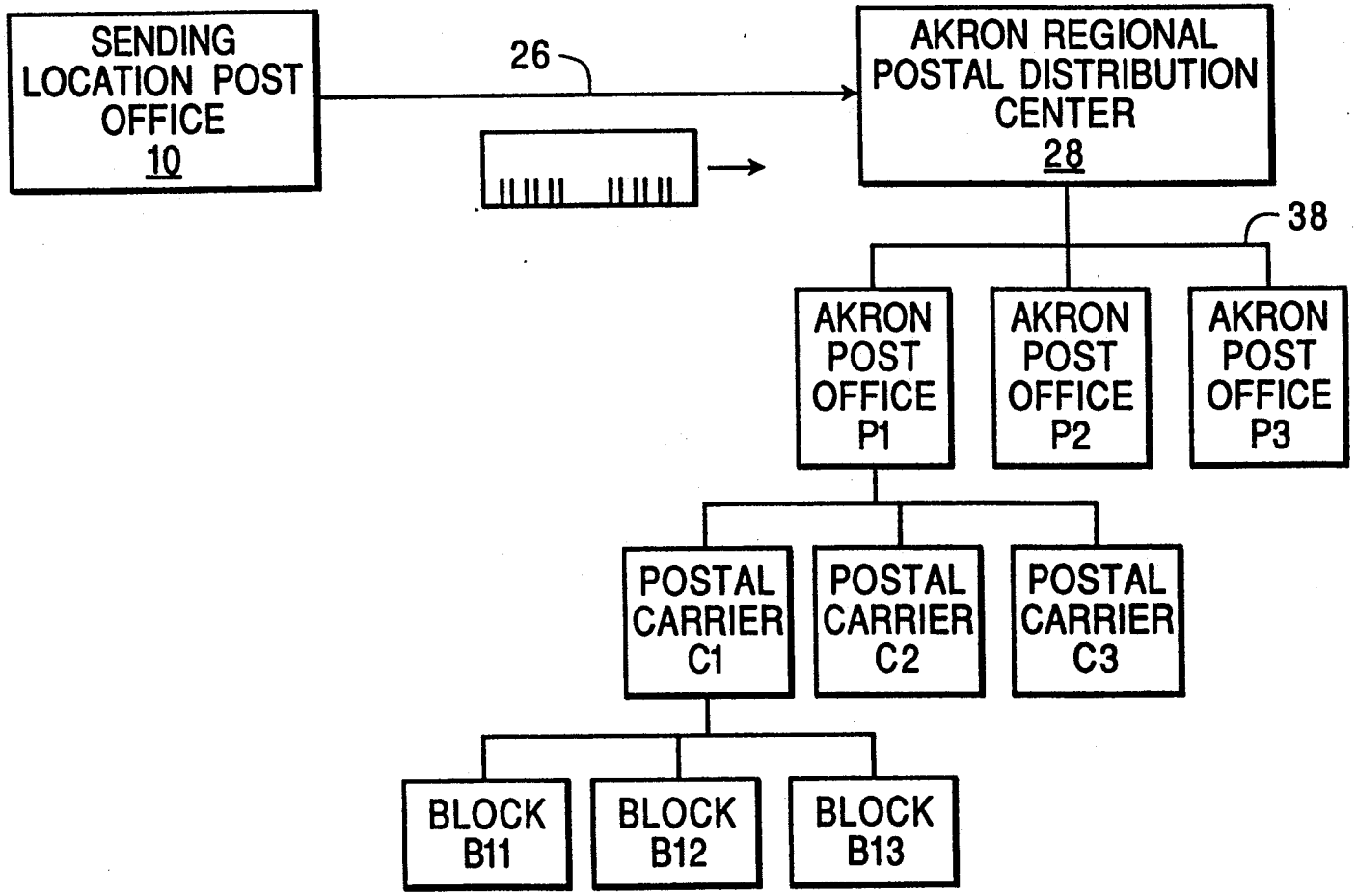
FIG. 2 is a diagram illustrating the distribution of a mail piece from the sending location to the regional postal distribution center for local distribution to local post offices.
Figure 3:
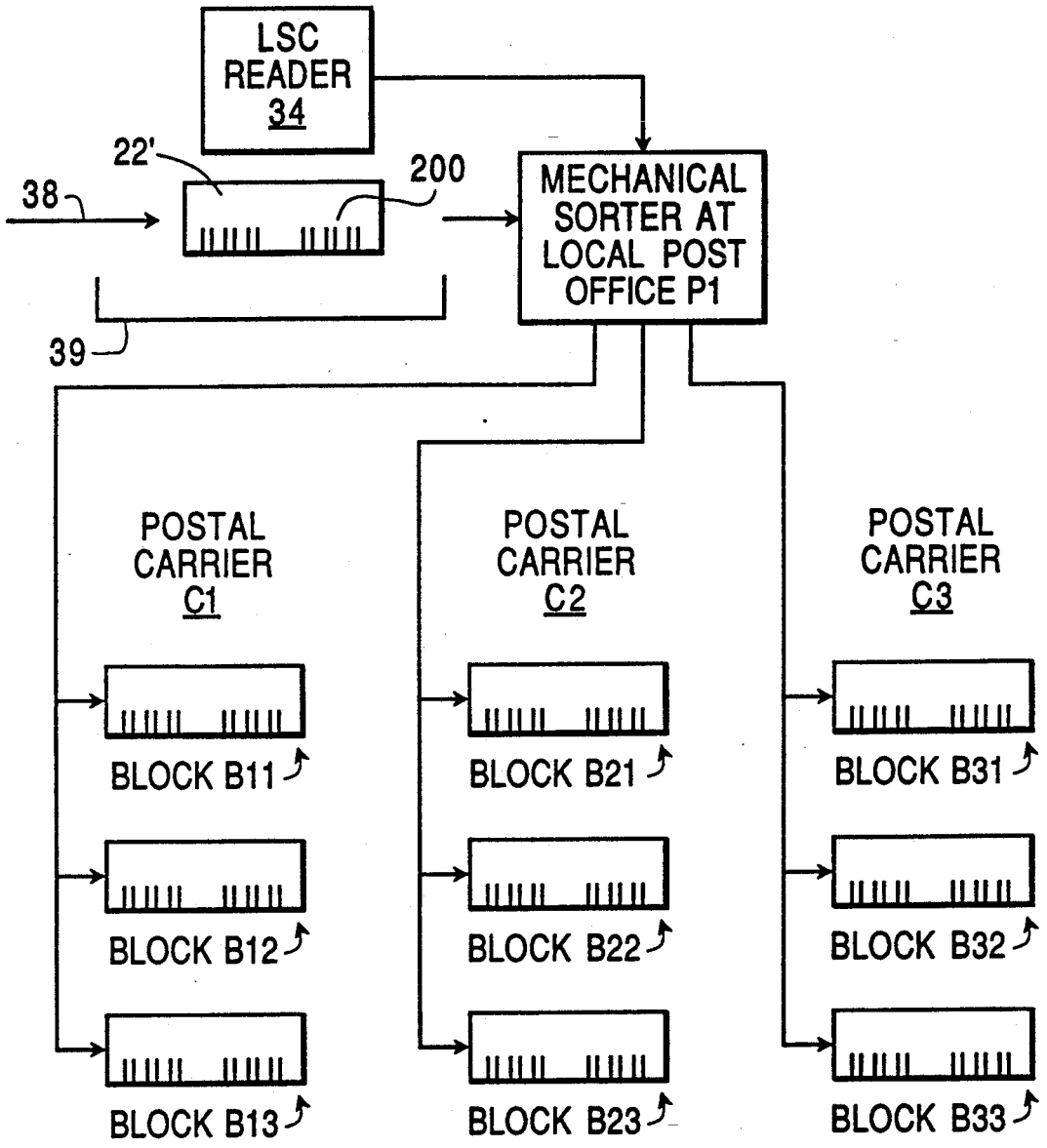
FIG. 3 is an organizational diagram illustrating the distribution of a mail piece when it arrives at a local post office.
Figure 4:
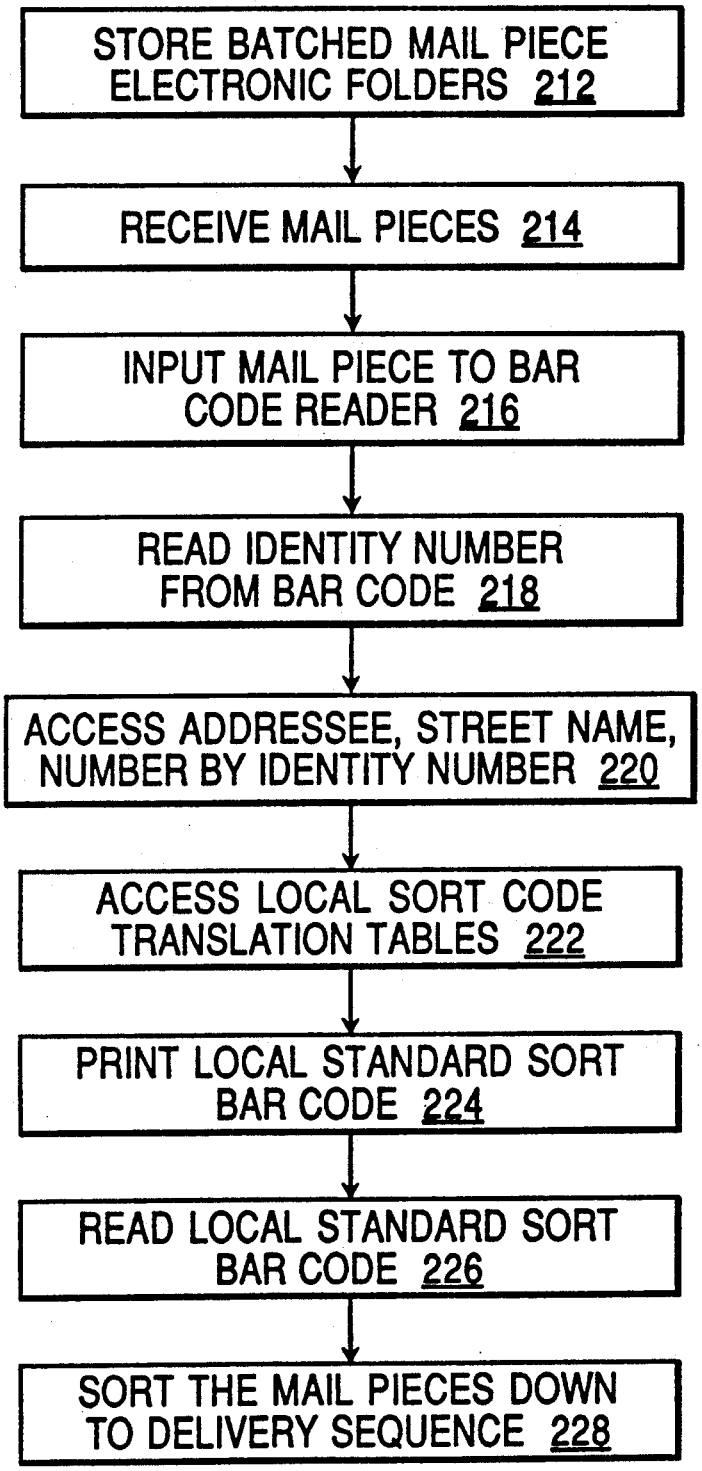
FIG. 4 is a flow diagram, in accordance with the invention.

FIG. 1 shows an architectural diagram of the data processing system at the destination regional postal distribution center 28. Reference to FIG. 2 illustrates how mail pieces are distributed from the sending location 10 to the regional postal distribution center 28. Reference to FIG. 3 will illustrate in detail how the mechanical sorting is carried out in a particular post office P1 within the destination region 28. FIG. 4 will illustrate the sequence of operational steps carried out at the destination regional postal distribution center 28 by the system shown in FIG. 1, to sort mail pieces down to the delivery sequence.

Figure 5:
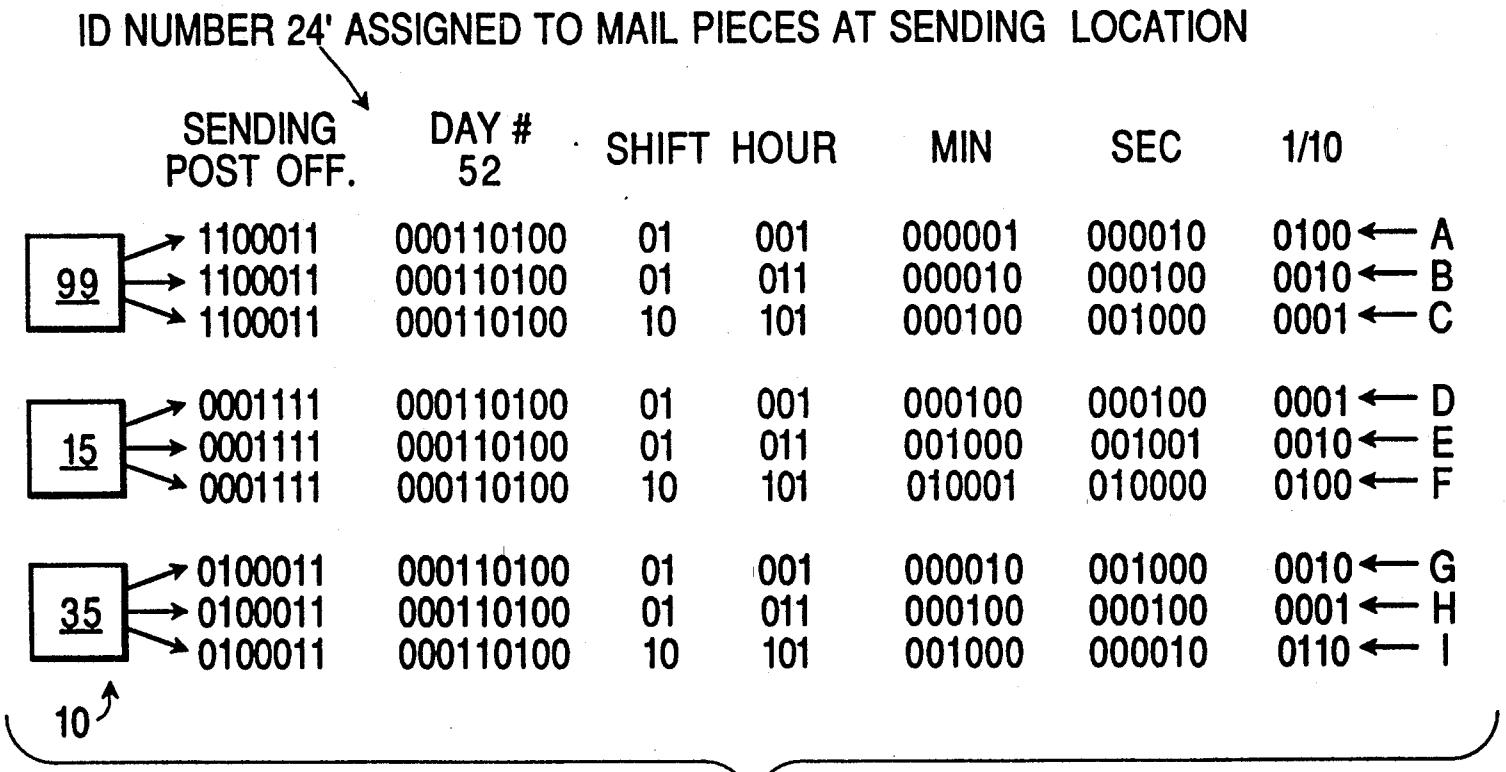
FIG. 5 illustrates the identification numbers 24' assigned to mail pieces at the sending location.

In FIG. 5, identification numbers 24' are assigned to mail pieces 22 at the sending location post office 10, as was described in the above cited Rosenbaum, et al. patent application. The identification numbers 24' can have a format as is shown in the example in FIG. 5 for the nine mail pieces being sent from the three sending post offices 99, 15 and 35. Post office 99 sends mail pieces A, B and C. Each of the mail pieces has a ID number 24' prepared for example, as follows. The sending post office 99 will have its numerical value converted into a binary expression which is used as a portion of the identification number 24'. The day number in the calendar year can be used as a second field as shown in FIG. 5. The day number can have a range from one through 365 or alternately can have a smaller range. An appropriate range for an efficiently running postal system would be from one through eight, since most mail pieces should be cleared out of the system in eight days. Thus, a three binary digit field can be used for the day number field for the identification numbers 24' in FIG. 5. Also, the work shift which can be either first, second or third shift can be specified as a portion of the identification number 24', the shift being that portion of the working day in which the mail piece is processed at the sending post office. In addition, the hour field which is a three bit field for the eight hours in a shift, can also be a field in the identification number 24'. Still further, the minute of processing and the second of processing and the tenth second of processing can be three respective fields which can be used in formulating the identification number 24' in FIG. 5. In this manner, an example set of three identification numbers is produced for the mail pieces A, B and C at the New York, N.Y. sending post office 99 in FIG. 5. Similarly, an additional three mail pieces D, E and F processed at the Raleigh, N.C. sending post office 15 can have corresponding identification numbers 24' as shown in FIG. 5. Still further, an additional three mail pieces G, H and I can have a corresponding respective three identification numbers 24' formulated at the Boca Raton, FL post office 35 in FIG. 5.

Figure 6A:
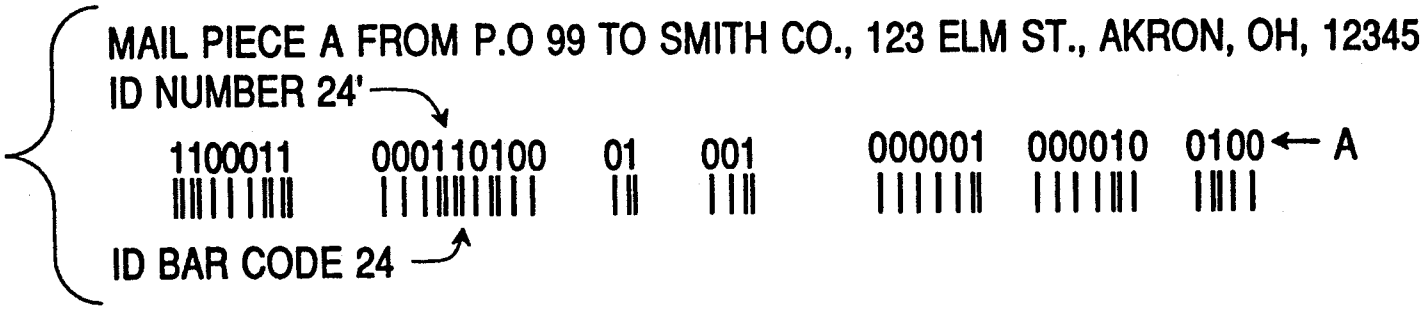
FIG. 6A illustrates the identification number 24' and the corresponding identification barcode 24 for mail piece "A."
Figure 6B:
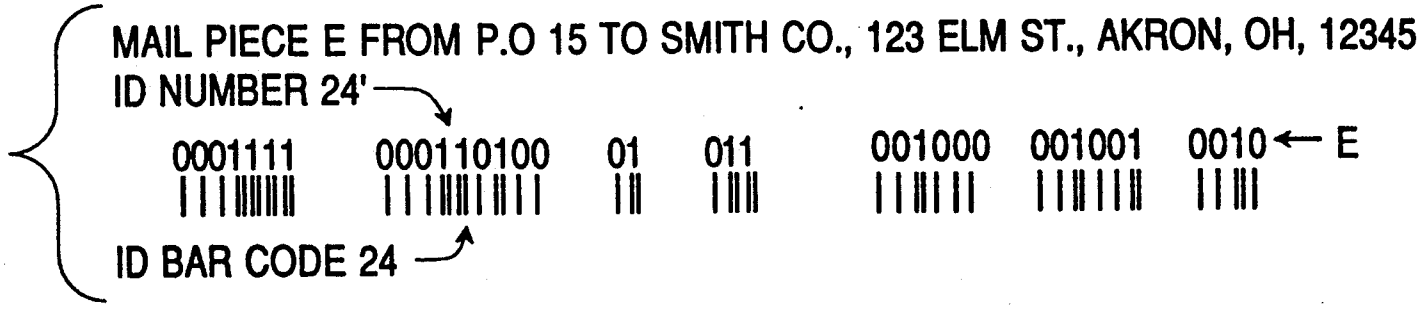
FIG. 6B illustrates the identification number 24' and the corresponding identification barcode 24 for mail piece "E."
Figure 6C:
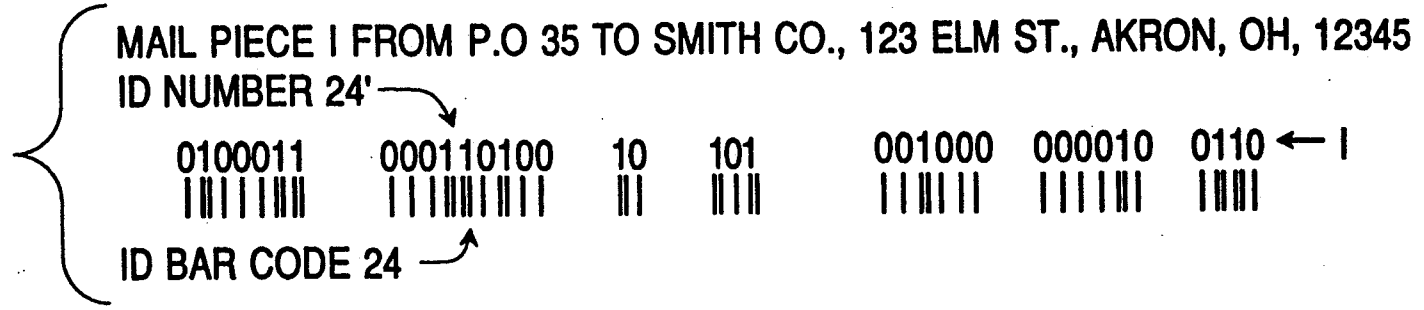
FIG. 6C illustrates the identification number 24' and the corresponding identification barcode 24 for mail piece "I."

FIG. 6A shows how the identification number 24' for the mail piece A will have its identification barcode 24' generated for printing on the front or the back of the mail piece A. Similarly, FIG. 6B will illustrate how the identification number 24' for the mail piece E will have its identification barcode 24 generated. Similarly, FIG. 6C illustrates how the mail piece I will have its identification number 24'transformed into the identification barcode 24. Note that the addressee for the mail pieces A, E and I is the same.

Figure 7:
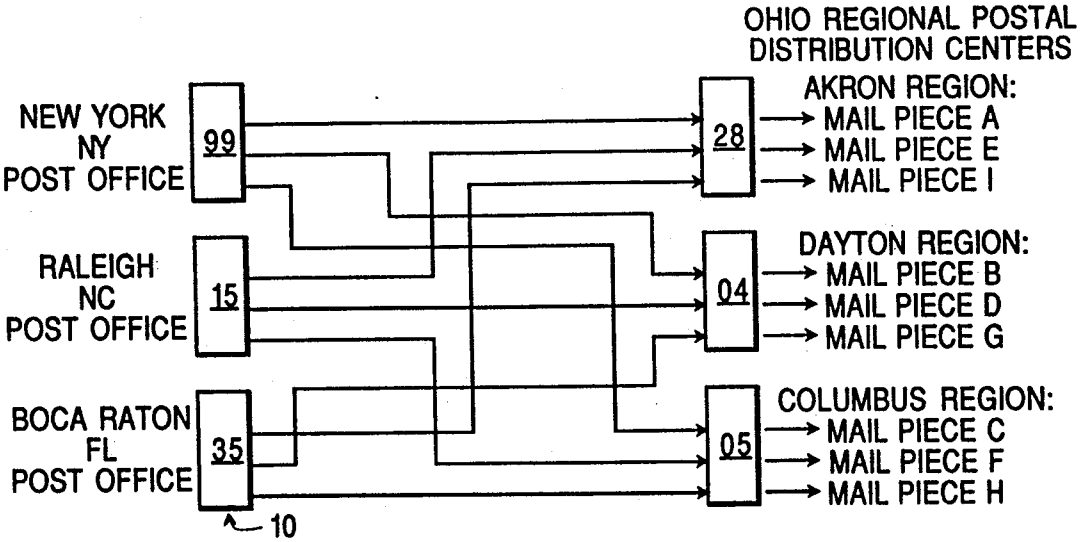
FIG. 7 is an organizational diagram illustrating the distribution of mail pieces from three sending post offices to three destination regional postal distribution centers.

FIG. 7 illustrates that sending location post office 99 is the New York, N.Y. post office, sending location post office 15 is the Raleigh, N.C. post office, and sending location post office 35 is the Boca Raton, Fla. post office. Also, FIG. 7 illustrates that the destination regional postal center 28 is for the Akron, Ohio region. The destination regional postal distribution center 04 is for the Dayton, Ohio region. The destination regional postal distribution center 05 is for the Columbus, Ohio region. Mail pieces A, E and I are addressed to the destination region 28, mail pieces B, D and G are directed to the 04 destination region, and the mail pieces C, F and H are directed to the destination region 05.

Figure 8:
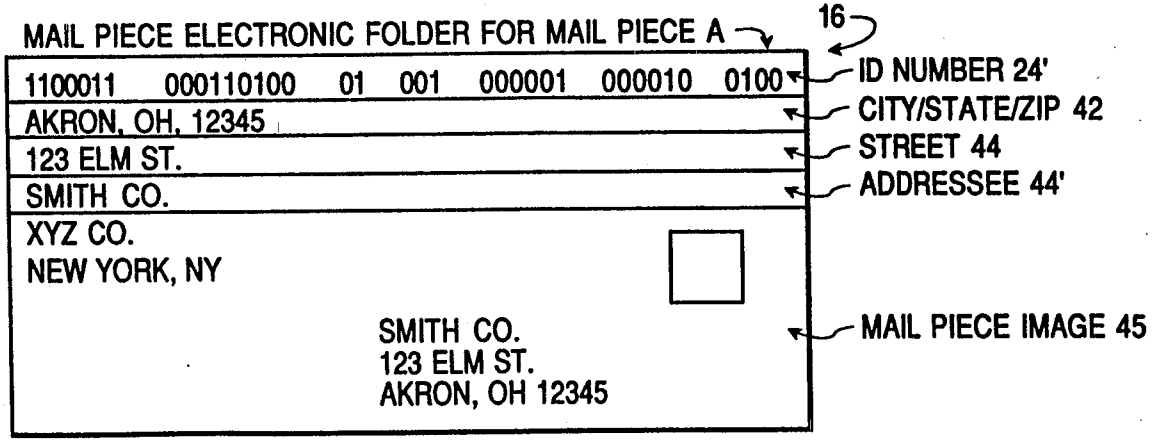
FIG. 8 illustrates the mail piece electronic folder for mail piece "A."

FIG. 8 illustrates the mail piece electronic folder for the mail piece A, showing in particular that the mail piece electronic folder 16 includes a first field for the ID number 24', a second field for the city, state, zip 42, a third field for the street information 44, a fourth field for the addressee information 44', and a fifth portion which stores the mail piece image 45, as is further described in the above referenced Rosenbaum, et al. patent application. Similarly, FIG. 9 illustrates the mail piece electronic folder for mail piece E, and FIG. 10 illustrates the mail piece electronic folder for the mail piece I.

Figure 9:
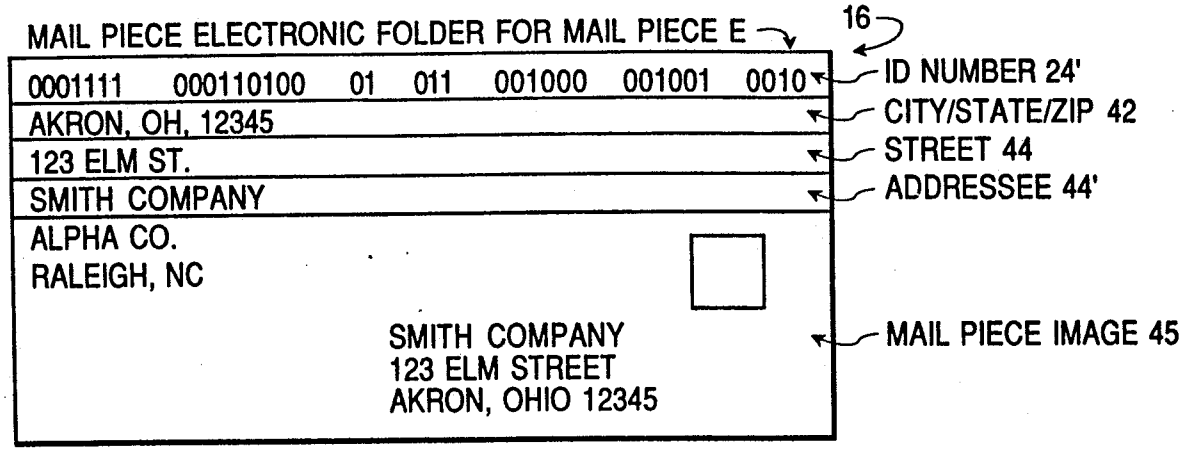
FIG. 9 illustrates the mail piece electronic folder for mail piece "E."
Figure 10:
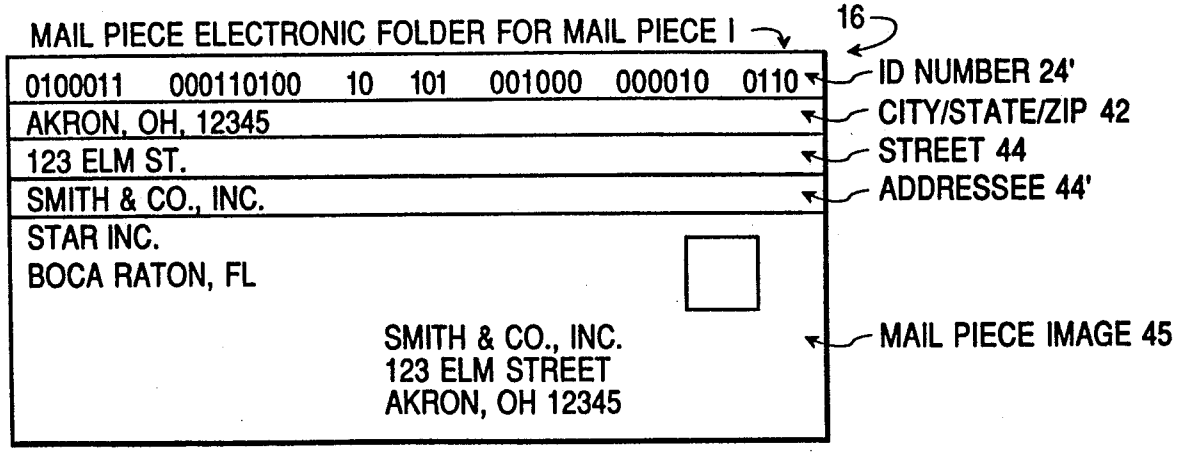
FIG. 10 illustrates the mail piece electronic folder for mail piece "I."

In the data processing system of FIG. 1 at the destination regional postal distribution center 28, the mail piece electronic folder 16 shown in FIGS. 8, 9 and 10 for the mail pieces A, E and I respectively, are received over the data communications link 29 by the communications adapter 27', in accordance with the description in the above referenced Rosenbaum, et al. patent application. The alphanumeric information in the mail piece electronic folder 16 for the identification number 24', the city, state, zip information 42, the street information 44 and the addressee information 44', are stored as the address data block 40 in the memory 19'. The captured image of the mail piece 45 is stored in the image data block 17 in the memory 19'.

The data processing system of FIG. 1 includes the bus 11' to which is connected the central processing unit (CPU) 23', the mass storage device 25', the communications adapter 27', and the memory 19'. Also connected to the bus 11' are the workstations 31'. A barcode reader 37' connected to the bus 11' is adapted to read the identification number barcode 24 on each mail piece 22 as it is delivered by the mail piece delivery system 26 onto the conveyor 12'. A principle object of the invention is to convert the identification barcode 24 into a local sort barcode 200 which can be read and processed by the particular type of barcode readers and mechanical sorting machines employed in the destination postal region 28. In order to accomplish this, the identification number 24'output by the barcode reader 37' from reading the barcode 24 on the front of the mail piece 22, is used as a query term to access the corresponding data block 40 for the mail piece 22, from the memory 19'. Then, in accordance with the invention, a local standard sort barcode 200 is formulated from local sort translation tables 210 in the memory 19'. The local sort code printer 202 connected to the bus 11', then prints the local sort barcode 200 on the front or alternately the back of the mail piece 22' shown in FIG. 1.

The mail piece 22' may continue on the same conveyor 12' in FIG. 1 to the sort machine 206 which is connected to the bus 11', for mechanical sorting into bins for each of the several local post offices P1, P2 or P3 served by the destination region postal distribution center 28. The sort machine 206 can be driven by the information derived from the address data block 40 to perform its mechanical sorting at 38. Alternately, the mail piece 22' on the conveyor 12' may be accumulated into trays and further sorting can be delayed, after which the mail piece 22' is delivered to the conveyor 50 as mail piece 22" where it passes by the local sort code reader 204 connected to the bus 11'. The local sort code reader 204 can read the local sort barcode 200 on the mail piece 22" and provide the necessary sorting information to the sort machine 206 to enable sorting to the local post offices served by the destination regional postal distribution center 28.

Figure 15:
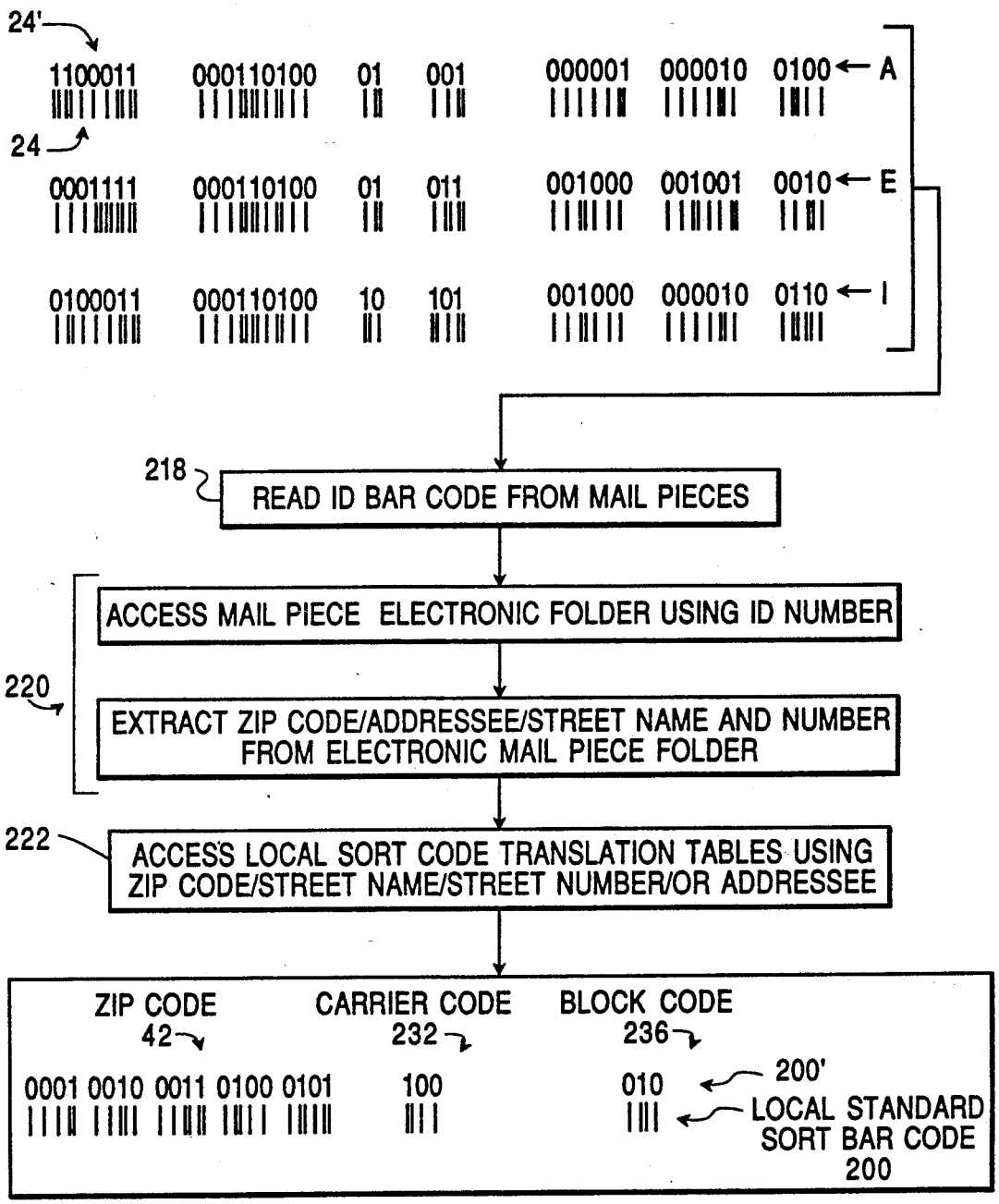
FIG. 15 is a flow diagram illustrating the barcode translation process.

The memory 19' includes the sortation program 208 which is a sequence of instructions which implements the barcode translation process of FIG. 15. The memory 19' can also include the resource allocation program 142 to provide management information from the quantity and destination distribution data for mail pieces expected to arrive on any given day. The operating system can also be included in memory 19'.

Figures 16, 17:
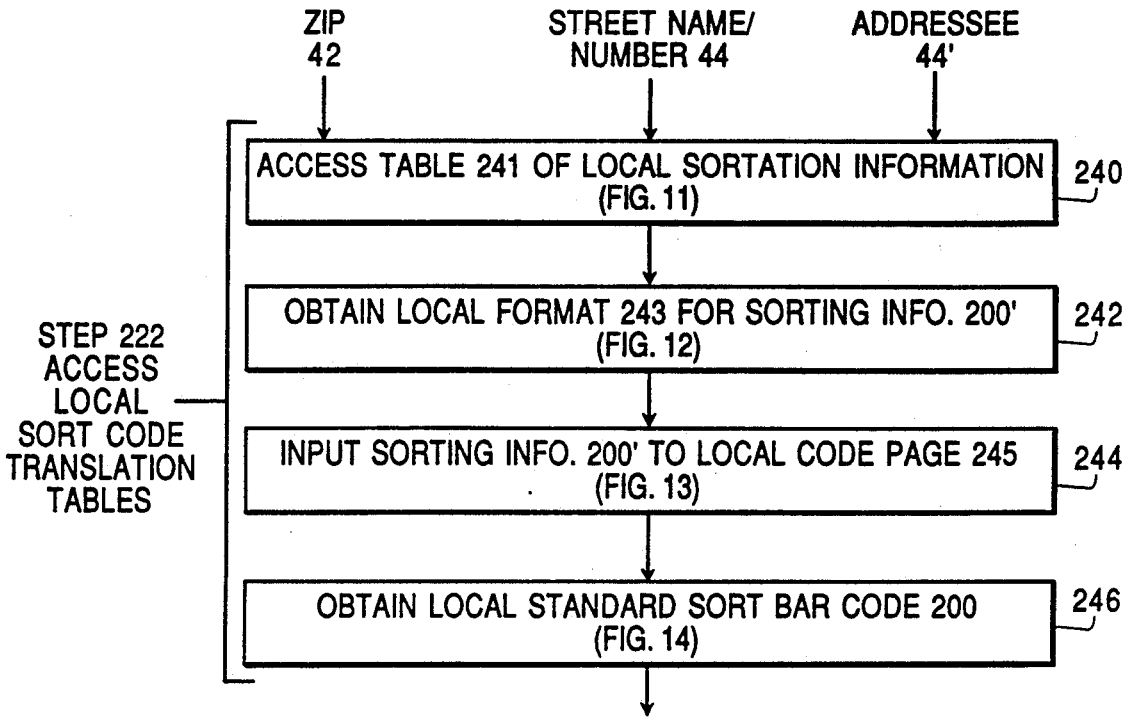
FIG. 16 is a more detailed flow diagram illustrating step 222 to access the local sort code translation tables.
FIG. 17 illustrates the memory partition in memory 19' for the local sort code translation tables 210.

FIG. 11 shows the local sortation information table 241 for the Akron Post Office Pl which is within the Akron regional postal distribution center 28. FIG. 11A shows a different local sortation information table 241 for a second local Akron Post Office P2 which is also served by the destination region postal distribution center 28. Reference to FIG. 17 will show the memory partition in memory 19' for the local sort code translation tables 210, and will in particular show that the table 241 for local sortation information for a local post office P1 and table 241 for local sortation information for the local post office P2 are a part of the local sort code translation tables 210. FIG. 12 shows the local format 243 for sorting information 200' for the destination region 28. The format shown in FIG. 12 includes a five digit zip code, a three digit carrier code, and a three digit block code. The local format 243 shown in FIG. 12 is also a part of the local sort code translation tables 210 in the memory partition of memory 19'.

FIG. 13 shows the local code page 245 for the destination postal distribution center region 28. The local code page 245 for the destination region 28 is a part of the local sort code translation tables 210 in the memory partition of the memory 19'. The local code page 245 converts the alphanumeric characters in the local information 200' of FIG. 12, into their binary number expressions 200' in FIG. 14, in ASCII, EBCDEC, BCD, or other locally used character convention. The local code page 245 then converts the resulting binary numbers "0" and "1" in FIG. 14, into the locally used barcode shapes and patterns 200.

Reference to FIG. 11 for the local sortation information table 241 from the local post office P1, will show the relationship between the zip code 42, the block 234, the block code 236, the carrier 230 and the carrier code 232. In accordance with the invention, the destination regional postal distribution center 28 is able to encode the local sort barcode 200 on each mail piece 22' so as to enable each mail piece to be mechanically sorted down to the carrier and walk sequence at each of the local post offices served by the regional distribution center 28. This is achieved by the process whose flow diagram is shown in FIG. 4. Step 212 stores the mail piece electronic folders in the memory 19' and they can also be stored in the mass storage 25' of the data processor of FIG. 1. Then in step 214, the mail pieces 22 are received at the conveyor 12' and in step 216 the mail piece 22 is input to the barcode reader 37'. The barcode reader 37' reads the identity number 24' from the barcode 24 in step 218. Then in step 220, the data processing system of FIG. 1 accesses the addressee, street name, street number information by using the identity number 24' as a query term, from the memory 19'. Then, in step 222, the data processing system of FIG. 1 accesses the local sort code translation tables 210.

Reference should now be made to the more detailed flow diagram of FIG. 16 which illustrates the step 222 of accessing the local sort code translation tables 210. In step 240 of FIG. 16, the zip information 42, street name and number 44, and addressee 44' can be used to access the table 241 of local sortation information, shown in greater detail in FIG. 11. Then in step 242, the local format 243 is obtained for sorting information 200', which is shown in greater detail in FIG. 12. Then in step 244, the sorting information 200' is input to the local code page 245 to generate the local sort barcode, the local code page being shown in greater detail in FIG. 13. Then in step 246, the local standard sort barcode 200 is obtained, as is shown in FIG. 14. Returning now to the flow diagram of FIG. 4, the local standard sort barcode 200 can now be printed by the printer 202 onto either the front or the back of the mail piece 22 converting it into the mail piece 22' of FIG. 1. At this point, the mail piece 22' can be set aside in a tray storage for later sorting and distribution. Once sorting and distribution are resumed, the local standard sort barcode 200 on the mail piece 22' is read by the reader 204 to obtain sufficient information to enable the physical distribution of the mail piece 22' to the local post office P1, P2 or P3 which is served by the regional postal distribution center 28. The sorting machine 206 which is driven by the data processing system in FIG. 1, sorts the mail pieces 22' to the sorting path 38. The sorting path 38 can be bins associated with each of the respective local post offices P1, P2 and P3. Mail pieces which are accumulated for distribution to the local post offices P1, P2 and P3 will then be physically transported to those respective post offices for further sorting and distribution as is shown in FIGS. 2 and 3.

In FIG. 2 it can be seen that the Akron regional postal distribution center 28 serves the three local post offices P1, P2 and P3 and sorts mail pieces over the sorting path 38. The local post office P1 has three postal carriers C1, C2 and C3. The postal carrier C1 has three blocks which he services in the delivery walk sequence, B11, B12 and B13, respectively. Turning to FIG. 3, the mechanical sorting at the local post office P1 is shown in greater detail. The mail piece 22' arrives over the path 38 and is transported on the conveyor 39 past the local sort barcode reader 34 where the local sort barcode 200 is read. Signals derived from the local sort barcode 200 are then applied to the mechanical sorter 36 for the physical sorting of the mail pieces 22' to the postal carriers C1, C2 and C3. The detailed nature of the information in the local sort barcode 200 enables the mechanical sorter 36 to sort the mail pieces 22' in the walk sequence for the postal carrier C1, in the delivery walk sequence order of block B11, B12 and B13, respectively. Similarly, the mechanical sorter 36 is applied with sufficient information from the reader 34 having read the local sort barcode 200, to enable mail pieces 22' to be sorted to the postal carrier C2 in delivery walk sequence with blocks B21, B22 and B23, respectively. Similarly, the detailed information in the local sort barcode 200 enables the mechanical sorter 36 to sort mail pieces 22' to the postal carrier C3 in the delivery walk sequence block B31, block B32 and block B33, respectively.

Reference can be made to FIG. 15 to further illustrate the barcode translations process which is carried out by the data processing system of FIG. 1 at the destination regional postal distribution center 28. FIG. 15 shows the barcodes 24 which are read from the three mail pieces A, E and I, resulting in the three identification numbers 24'. It will be noted that the barcodes 24 and the identification numbers 24' are all different even though they have the same addressee. FIG. 15 shows in step 218 that the identification number barcode 24 is read from the mail pieces. Then step 220 shows two component steps, the first being to access the mail piece electronic folder 16 using the identification number 24' and the second step being to extract the zip code 42, addressee 44', street name and number 44 information from the electronic mail piece folder 16. Then step 222 calls for accessing the local sort code translation tables 210 using the zip code/street name/street number/addressee. The culmination of this process is the production of the local standard sort barcode 200 which is shown at the bottom of FIG. 15.

Another feature of the invention is the ability to accommodate regional postal standards for code page or format diversity. For example, FIG. 18 shows an example local code page 245 for Dayton, Ohio region. Note that the barcodes 48' for representing the binary zero and the binary one are different from the barcodes 48 in FIG. 13 for the Akron, Ohio region. This results in the production of a local barcode 200 shown in FIG. 19 which has a different appearance than that which is shown in FIG. 14 for the Akron, Ohio example. Another difference can be seen in FIG. 19 in that the local format 243 employs just the last three digits of the zip code 42 instead employing all five digits in FIG. 14 for the Akron, Ohio region. Such differences can take place because of differing barcode reader and sorting apparatus at the diverse postal regions in a country or between one country and another. One of the advantages of the invention is the ability to accommodate this diversity in code page definitions and formats for the local barcode.

Another example of a diversity in local code page and local format is shown in FIGS. 20 and 21 for Copenhagan, Denmark. As can be seen in FIG. 20, the local code page 245 specifies barcodes 48'' which are different for binary zero and binary one than they appear in either FIGS. 13 or 18. Also, the example Copenhagan local format 243 makes use of the last two digits of the zip code, resulting in a local barcode 200 which has a different appearance in FIG. 21 than that shown in FIG. 19 or that shown in FIG. 14.

Thus it is seen that by operation of the invention, a diversity of local barcode formats, code pages, and information content can be accommodated in providing for the sorting of mail pieces at a regional distribution center down to the carrier and walk sequence for local post offices served by that region distribution center. In this manner, the need for operator intervention in the handling and sorting of mail pieces is significantly reduced.

Although a specific embodiment of the invention has been disclosed, it will be understood by those having skill in the art that changes can be made to that specific embodiment without departing from the spirit and the scope of the invention.

What is claimed is:

1. In a system for deferred processing of a mail piece having a destination address block whose image is character recognized to produce destination address data which is associated with an identification number encoded as an indicium onto the mail piece, the destination address data being transmitted to a mail piece distribution station which employs a first sorting device to sort to a second sorting device using a local sort code, a method for encoding the mail piece for automatic sorting to the destination location, comprising the steps of:

storing local sort code translation tables in a computer memory coupled to said first sorting device;

storing said destination address data in said computer memory;

identifying said mail piece at said distribution station by reading said indicium thereon;

accessing said destination address data using said identification number represented by said indicium;

converting said destination address data into a local sort code using said translation tables;

printing said local sort code onto said mail piece;

reading said printed local sort code in a second sorter and sorting the mail piece to the destination location.

2. The method of claim 1, wherein said indicium is a barcode with a first format and said printed local sort code is a barcode with a second format.

3. The method of claim 2, wherein said translation tables include a local format table to convert said destination address data to said second format.

4. The method of claim 1, wherein said indicium is a barcode with a first bar character shape and said printed local sort code is a barcode with a second bar character shape.

5. The method of claim 4, wherein said translation tables include a local code page to convert said destination address data to said second bar character shape.

6. The method of claim 1, wherein said translation tables include local sortation information having a carrier code and a block code, enabling said printed local sort code to control said second sorter to sort the mail piece down to carrier and walk sequence.

7. The method of claim 6, wherein said translation tables include second local sortation information for a second destination location.

8. In a system for deferred processing of a mail piece having a destination address block whose image is character recognized to produce destination address data which is associated with an identification number encoded as an indicium onto the mail piece, the destination address data being transmitted over a network to a mail piece distribution station which employs a first sorting device to sort to a second sorting device using a local sort code, apparatus for encoding the mail piece for automatic sorting to the destination location, comprising:

a computer memory coupled to said first sorting device, for storing local sort code translation tables;

said computer memory coupled to said network, for storing said destination address data;

reading means coupled to said computer memory, for identifying said mail piece at said distribution station by reading said indicium thereon;

a data processor coupled to said memory and said reading means, for accessing said destination address data using said identification number represented by said indicium;

said data processor converting said destination address data into a local sort code using said translation tables;

printing means coupled to said data processor, for printing said local sort code onto said mail piece;

said second sorter reading said printed local sort code on said mail piece and sorting said mail piece to the destination location.

9. The apparatus of claim 8, wherein said indicium is a barcode with a first format and said printed local sort code is a barcode with a second format.

10. The apparatus of claim 9, wherein said translation tables include a local format table to convert said destination address data to said second format.

11. The apparatus of claim 8, wherein said indicium is a barcode with a first bar character shape and said printed local sort code is a barcode with a second bar character shape.

12. The apparatus of claim 11, wherein said translation tables include a local code page to convert said destination address data to said second bar character shape.

13. The apparatus of claim 8, wherein said translation tables include local sortation information having a carrier code and a block code, enabling said printed local sort code to control said second sorter to sort the mail piece down to carrier and walk sequence.

14. The apparatus of claim 13, wherein said translation tables include second local sortation information for a second destination location.

15. In a system for deferred processing of a mail piece having a destination address block whose image is character recognized to produce destination address data which is associated with an identification number printed as an indicium onto the mail piece, the destination address data being transmitted over a data communications network to a mail piece distribution station which distributes the mail piece to a sorting station for sorting using a local standard sort code, apparatus for encoding the mail piece for automatic sorting to the destination location, comprising:

a computer memory coupled to said network, for storing said destination address data;

said computer memory also storing local standard sort code translation tables which include carrier an delivery sequence data for the destination location;

reading means coupled to said computer memory, for identifying said mail piece at said distribution station by reading said indicium thereon;

a data processor coupled to said memory and said reading means, for accessing said destination address data using said identification number represented by said indicium;

said data processor converting said destination address data into a local standard sort code using said translation tables;

a printer coupled to said data processor, for printing said local standard sort code onto said mail piece at said distribution station;

a sorter for reading said printed local standard sort code on said mail piece and sorting said mail piece down to carrier and walk sequence for the destination location.

16. In a system for deferred processing of a mail piece having a destination address block whose image is character recognized to produce destination address data which is associated with an identification number printed as an indicium onto the mail piece, the destination address data being transmitted over a data communications network to a mail piece distribution station which distributes the mail piece to a sorting station for sorting using a local standard sort code, apparatus for encoding the mail piece for automatic sorting to the destination location, comprising:

a computer memory coupled to said network, for storing said destination address data;

said computer memory also storing local standard sort code translation tables which include carrier and delivery sequence data for the destination location, a local format table to convert said destination address data to a local format for the destination location and a local code page to convert said destination address data to local character shapes;

reading means coupled to said computer memory, for identifying said mail piece at said distribution station by reading said indicium thereon;

a data processor coupled to said memory and said reading means, for accessing said destination address data using said identification number represented by said indicium;

said data processor using said translation tables to convert said destination address data into a local standard sort code which includes said carrier and delivery sequence data for the destination location, said local format for the destination location and said local character shapes for the destination location;

a printer coupled to said data processor, for printing said local standard sort code onto said mail piece at said distribution station, using said local format and said local character shapes;

a sorter for reading said printed local standard sort code on said mail piece and sorting said mail piece down to carrier and walk sequence for the destination location.

17. A system for deferred processing of a mail piece having a destination address block, comprising:

image capture means at a sending location for generating an image of a mail piece destination address block;

first printer at said sending location for printing an indicium representing an identification number onto said mail piece;

character recognition means coupled to said image capture means, for recognizing at least a portion of said destination address block and generating destination address data;

data communication means coupled to said character recognition means for transmitting said destination address data and said identification number over a data communications network to a mail piece distribution station which distributes the mail piece to a sorting station for sorting to a destination location using a local standard sort code;

a computer memory coupled to said network, for storing said destination address data;

said computer memory also storing local standard sort code translation tables which include carrier and delivery sequence data for the destination location, a local format table to convert said destination address data to a local format for the destination location and a local code page to convert said destination address data to local character shapes for the destination location;

reading means coupled to said computer memory, for identifying said mail piece at said distribution station by reading said indicium thereon;

a data processor coupled to said memory and said reading means, for accessing said destination address data using said identification number represented by said indicium;

said data processor using said translation tables to convert said destination address data into a local standard sort code which includes said carrier and delivery sequence data for the destination location, said local format for the destination location and said local character shapes for the destination location;

a second printer coupled to said data processor, for printing said local standard sort code onto said mail piece at said distribution station, using said local format and said local character shapes;

a sorter for reading said printed local standard sort code on said mail piece and sorting said mail piece down to carrier and walk sequence for the destination location.

18. In a system for deferred processing of a mail piece having a destination address block whose image is rekeyed to produce destination address data which is associated with an identification number printed as an indicium onto the mail piece, the destination address data being transmitted over a data communications network to a mail piece distribution station which distributes the mail piece to a sorting station for sorting using a local standard sort code, apparatus for encoding the mail piece for automatic sorting to the destination location, comprising:

a computer memory coupled to said network, for storing said destination address data;

said computer memory also storing local standard sort code translation tables which include carrier and delivery sequence data for the destination location;

reading means coupled to said computer memory, for identifying said mail piece at said distribution station by reading said indicium thereon;

a data processor coupled to said memory and said reading means, for accessing said destination address data using said identification number represented by said indicium;

said data processor converting said destination address data into a local standard sort code using said translation tables;

a printer coupled to said data processor, for printing said local standard sort code onto said mail piece at said distribution station;

a sorter for reading said printed local standard sort code on said mail piece and sorting said mail piece down to carrier and walk sequence for the destination location.

19. In a system for deferred processing of a mail piece having a destination address block whose image is rekeyed to produce destination address data which is associated with an identification number printed as an indicium onto the mail piece, the destination address data being transmitted over a data communications network to a mail piece distribution station which distributes the mail piece to a sorting station for sorting using a local standard sort code, apparatus for encoding the mail piece for automatic sorting to the destination location, comprising:

a computer memory coupled to said network, for storing said destination address data;

said computer memory also storing local standard sort code translation tables which include carrier and delivery sequence data for the destination location, a local format table to convert said destination address data to a local format for the destination location and a local code page to convert said destination address data to local character shapes;

reading means coupled to said computer memory, for identifying said mail piece at said distribution station by reading said indicium thereon;

a data processor coupled to said memory and said reading means, for accessing said destination address data using said identification number represented by said indicium;

said data processor using said translation tables to convert said destination address data into a local standard sort code which includes said carrier and delivery sequence data for the destination location, said local format for the destination location and said local character shapes for the destination location;

a printer coupled to said data processor, for printing said local standard sort code onto said mail piece at said distribution station, using said local format and said local character shapes;

a sorter for reading said printed local standard sort code on said mail piece and sorting said mail piece down to carrier and walk sequence for the destination location.

20. A system for deferred processing of a mail piece having a destination address block, comprising:

image capture means at a sending location for generating an image of a mail piece destination address block;

first printer at said sending location for printing an indicium representing an identification number onto said mail piece;

rekeying means coupled to said image capture means, for displaying at least a portion of said image of said destination address block to an operator, enabling the operator to enter destination address data;

data communication means coupled to said rekeying means for transmitting said destination address data and said identification number over a data communications network to a mail piece distribution station which distributes the mail piece to a sorting station for sorting to a destination location using a local standard sort code;

a computer memory coupled to said network, for storing said destination address data;

said computer memory also storing local standard sort code translation tables which include carrier and delivery sequence data for the destination location, a local format table to convert said destination address data to a local format for the destination location and a local code page to convert said destination address data to local character shapes for the destination location;

reading means coupled to said computer memory, for identifying said mail piece at said distribution station by reading said indicium thereon;

a data processor coupled to said memory and said reading means, for accessing said destination address data using said identification number represented by said indicium;

said data processor using said translation tables to convert said destination address data into a local standard sort code which includes said carrier and delivery sequence data for the destination location, said local format for the destination location and said local character shapes for the destination location;

a second printer coupled to said data processor, for printing said local standard sort code onto said mail piece at said distribution station, using said local format and said local character shapes;

a sorter for reading said printed local standard sort code on said mail piece and sorting said mail piece down to carrier and walk sequence for the destination location.

21. In a system for deferred processing of a mail piece having a destination address block whose image is character recognized to produce destination address data which is associated with an identification number encoded as an indicium onto the mail piece, the destination address data being transmitted to a mail piece distribution station which employs a first sorting device to sort to a second sorting device using a local sort code, a method for encoding the mail piece for automatic sorting to the destination location, comprising the steps of:

storing local sort code translation tables in a computer memory coupled to said first sorting device;

sorting said destination address data in said computer memory;

printing said indicium onto said mail piece;

identifying said mail piece at said distribution station by reading said indicium thereon;

accessing said destination address data using said identification number represented by said indicium;

converting said destination address data into a local sort code using said translation tables;

printing said local sort code onto said mail piece;

reading aid printed local sort code in a second sorter and sorting the mail piece to the deviation location.

* * * * *